US005895743A

United States Patent [19]

Roefs et al.

[11] Patent Number: 5,895,743

[45] Date of Patent: Apr. 20, 1999

[54] METHOD OF PROCESSING LIGHT-SENSITIVE SILVER HALIDE PHOTOGRAPHIC MATERIALS

[75] Inventors: André Roefs, Herentals; Benedictus Jansen, Geel; Frank Michiels, Arendonk, all of Belgium

[73] Assignee: AGFA-Gevaert, N.V., Mortsel, Belgium

[21] Appl. No.: 08/990,088

[22] Filed: Dec. 12, 1997

Related U.S. Application Data

[60] Provisional application No. 60/037,967, Feb. 20, 1997.

[30] Foreign Application Priority Data

Dec. 30, 1996 [EP] European Pat. Off. ..... 96203727

[51] Int. Cl.[6] ..... G03C 5/38

[52] U.S. Cl. ..... 430/419; 430/427; 430/456

[58] Field of Search ..... 430/419, 427, 430/456

[56] References Cited

U.S. PATENT DOCUMENTS

| | | | |
|---|---|---|---|
| 3,867,151 | 2/1975 | Katz | 430/456 |
| 4,960,683 | 10/1990 | Okazaki et al. | 430/428 |
| 5,300,405 | 4/1994 | Yamada et al. | 430/363 |
| 5,318,881 | 6/1994 | Bucci et al. | 430/456 |

FOREIGN PATENT DOCUMENTS 0 500 045 A1 8/1992 European Pat. Off. .

OTHER PUBLICATIONS

Derwent Abstract re JP 03 068 937 A (Konica Corporation) Mar. 25, 1991.

Derwent Abstract re JP 06 250 350 A (Fuji Photo Film Co Ltd), Sep. 9, 1994.

Derwent Abstract re JP 06 230 527 A (Fuji Photo Film Co Ltd), Aug. 19, 1994.

Derwent Abstract re JP 05 100 392 A (Chugai Shashin Yakuhin KK), Apr. 23, 1993.

*Primary Examiner*—Hoa Van Le

*Attorney, Agent, or Firm*—Breiner & Breiner

[57] ABSTRACT

A method is disclosed of processing in a processor an image-wise exposed black-and-white light-sensitive silver halide photographic material comprising the steps of developing in a developing solution and fixing in a fixer solution, characterized in that upon starting of the processing the said fixer solution comprises a mixture of a fixer starter solution and a fixer replenisher solution, in that said fixer solution is replenished with the said fixer replenishing solution and in that the said fixer starter solution is a developing solution.

12 Claims, 1 Drawing Sheet

METHOD OF PROCESSING LIGHT-SENSITIVE SILVER HALIDE PHOTOGRAPHIC MATERIALS

Figure 1:
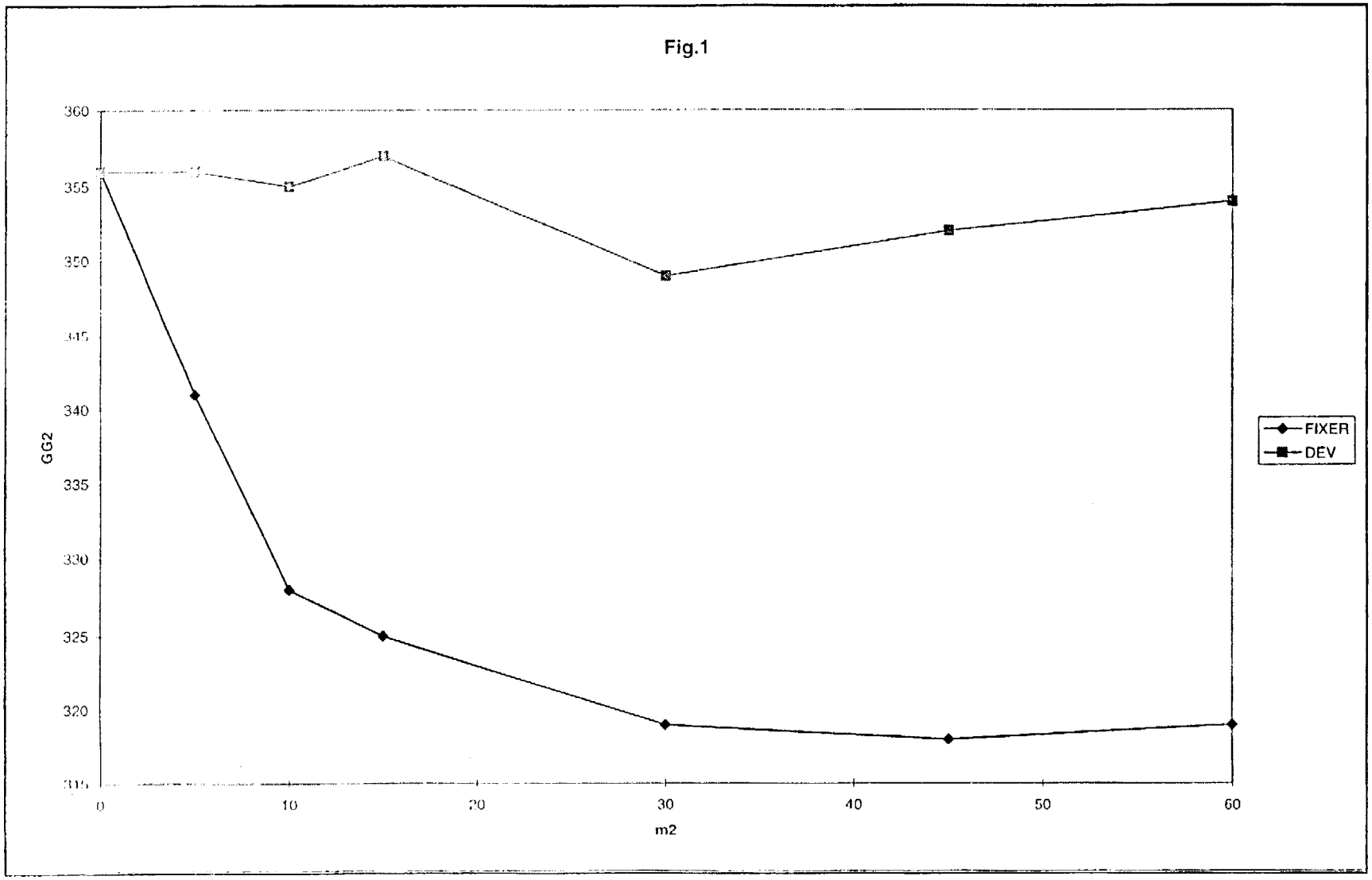

The application claims the benefit of U.S. Provisional Application No. 60/037,967 filed Feb. 20, 1997.

1. FIELD OF THE INVENTION

This invention is related with a black-and-white processing method in a processor of a black-and-white silver halide photographic material. In particular it is related with fixing solutions used as fixer starter solutions.

2. BACKGROUND OF THE INVENTION

As is well-known in the processing of photographic materials seasoning of the processing solutions makes their compositions differ from the compositions of solutions added freshly to processing tanks of developer and fixer. Therefore as an efficient measure in order to minimize differences in compositions between start and while running processing, the use of starter solutions is well-known since quite a long time as has e.g. been illustrated in U.S. Pat. No. 3,276,874. More recently in EP-A 0 696 759 a method for processing a black-and-white silver halide photographic material in an automatic processing machine or processor is disclosed, wherein the developer replenisher is used in the form of a concentrated solution or in the form of a solid comprising a dihydroxybenzene or ascorbic or erythorbic acid or derivatives thereof.

A developer replenisher having a higher pH value (in an amount of at least 0.5) than its development starting solution has been described in U.S. Pat. No. 5,503,965. Addition of starter, including at least one alkali agent, to the fixer in order to have a difference of pH between new liquid and running liquid within 0.2 has been described for a fixer having a pH after adding starter from 4.0 to 5.0 as in JP-A 03-68937, whereas a pH from 4.3 to 5.3 is controlled in JP-A 06-250350. Replenishing fixer solutions having a higher thiosulphate concentration than in the fixer at the start of processing, wherein pH of the fixer is more than 3.8 and preferably from 4.2–5.5 has been described in JP-A 06-230527, for rapid processing applications. Starter tablets have further been described in JP-A 04-032839.

The addition of sulfite salts to the fixer replenisher solution is known in order to compensate for the drop in sulphite concentration and pH decrease due to electrolysis. Electrolysis can proceed for example by passing the fixer around a circulation loop which includes an electrolytic cell. Electrolytic removal of silver also has the benefit of enabling a lower regeneration rate of fixer to be used. This is fully consistent with recent trends to reduce the volume of treatment liquids used in photographic processing. Electrolysis of the fixer solution, known as most efficient method of chemical recovery of the said fixer solution in order to reduce the slow down effect on fixation rate of increasing amounts of silver ions present in the fixer, however makes pH and sulfite ion concentration decrease.

As a consequence a less stable fixer solution is provided, wherein sulfur deposit may tend to occur as has e.g. been described in J.Imag.Techn. Vol. 10 (1984), p. 214 and in Materials Evaluation, April 1991, p. 511.

As an approach of modern technological developments related with rapid processing from the viewpoint of ecology is becoming more and more stringent, a demand for lower replenisher volumes is a normal trade-off. As a consequence differences in compositions between seasoned processing solutions and fresh solutions after throughput of constant amounts of photographic material tend to increase. The said differences are the ultimate factors determining to what extent reduction in replenishing amounts may be carried out.

Problems resulting therefrom are e.g. lack for constant and acceptable sensitometric properties (a "must" with respect to "constant quality" required by the clients), degradation of physical properties (e.g. uneven gloss at the surface of the processed and dried material) and unacceptable odour of the processing solutions.

3.OBJECTS OF THE INVENTION

Therefore it is an object of the present invention to provide constant sensitometric and physical properties of silver halide photographic material s after rapid processing in solutions replenished with minimum amounts of said solutions.

It is a further object of the present invention to specifically minimize the difference between the freshly pre pared fixer solution and the fixer solution after seasoning.

Other objects will become apparent from the description hereinafter.

4.SUMMARY OF THE INVENTION

The objects of the present invention have been attained by providing a method of processing in a processor an image-wise exposed black-and-white light-sensitive silver halide photographic material comprising the steps of developing in a developing solution and fixing in a fixer solution, characterized in that upon starting of the processing the said fixer solution comprises a mixture of a fixer starter solution and a fixer replenisher solution and in that said fixer solution is replenished with the said fixer replenishing solution.

In a preferred embodiment said method comprises the step of mixing a fixer starter solution and a fixer replenisher solution in a fixer unit or tank of the said processor.

5. DETAILED DESCRIPTION

In the present invention it has been found unexpectedly that the fixer solution used in the method of the present invention has an important influence on the sensitometric results.

An unexpected advantage indeed is that a desired constant sensitometry is obtained for black-and-white silver halide photographic materials run in a processor wherein the method of processing according to the present invention is applied.

This unexpected effect is certainly not suggested nor can it be learned from the available literature or patent literature anywhere. Therefore we especially refer to the Examples 1 and 2 and FIG. 1, added hereinafter, to illustrate the said unexpected effect which has been found by application of the method described in the present invention.

Indeed although it has been established that problems as set forth in the background of the invention can be avoided to a large extent by making use of a developer starter solution, it has been found in the present invention that further improvements in order to minimize differences of performance of a photographic system are attained by minimizing differences in the composition between fresh and seasoned fixer solution, in that upon starting the process with a fresh fixer, the fixer solution chemistry in the processor is the replenishment fixer solution chemistry with a supplementary additive mixed therewith, said supplementary additive being the fixer starter solution. In a preferred embodiment said supplementary additive is the (fresh or used) developing solution which acts as fixer starter solution. In a further preferred embodiment the fixer starter solution comprises developing agent(s) in a molar amount versus thiosulphate ions in the fixer replenisher solution of from 0.015 up to 0.080.

Said "fresh fixer" is defined as the fixer present in the fixer unit of the processor before any film has passed, or in the alternative, the fixer in which a very little amount of film was run, well before a steady state or equilibrium situation is reached (e.g. resulting in a "half-seasoned" fixer).

The "fixer replenisher solution" is defined as the unused fixer present in the fixer container which is, in the method of the present invention, mixed in the fixer unit with fixer starter solution in order to prepare the "fresh fixer" solution defined hereinbefore. It is clear that said "fixer replenishing solution" is added further to the fixer unit as the film is being processed, acting as a commonly used "replenisher" too.

The "seasoned fixer" is defined as the fixer present in the fixer unit of the processor after processing enough film in order to reach a steady-state or an equilibrium situation, depending on the amounts of replenisher used. In order to reach said steady-state, the said fixer is topped up with the "fixer replenisher solution" defined hereinbefore.

Until now it was well-known to add starter solution to the replenishing solutions but it was not common practice to add starter solution to the freshly prepared processing solutions and it was certainly not known, nor suggested to add a starter solution to replenishing solution present as fresh processing solution in the processing unit, which moreover results in a modification of the fresh fixer solution.

As already mentioned hereinbefore the said fixer solution comprises a mixture of a fixer starter solution and fixer replenisher solution, wherein it is understood that both solutions have been mixed before addition to the fixer unit or tank of the automatic processor. In another embodiment an additional step is the step of adding of a fixer starter solution to the fixer replenisher solution which is present in the said fixer unit or tank. In that case said fixer starter solution is preferably added before starting processing, although it is not excluded to add the said fixer starter solution during processing, i.e. after the processing has been started, before an equilibrium or seasoned state has been reached. It is clear however that the advantages related with this invention will only fully be attained when addition of the said starter fixer solution proceeds before starting the processing cycle, i.e. when adding fixer starter solution to fixer replenisher solution the latter being present in a fixer unit or tank of the processor. The case wherein fixer starter solution is present in the fixer tank before fixer replenishing solution is added thereto and mixed therewith is however not excluded, so that more generally the method of the present invention comprises the step of mixing of fixer starter solution and fixer replenishing solution in a fixer unit or tank of the said processor. In a preferred embodiment said fixer starter solution is mixed with the fixer replenishing solution in the processor before starting processing.

In a preferred embodiment said fixer starter solution is thus a developing solution. According to the method of the present invention the fixer starter solution comprises developing agent(s) in a molar amount versus thiosulphate ions in the fixer replenisher solution of from 0.015 up to 0.080.

In another embodiment according to the method of the present invention the fixer starter solution is a buffering solution. Said buffering solution alters pH of the fixer to the required value: so in a preferred embodiment said fixer starter solution alters pH to a value in the range from −0.3 up to +0.3 units of the pH of the fixer solution after seasoning. Lowering pH by addition of fixer starter solution (to a pH value of e.g. 4.5) by mixing with fixer replenisher solution is especially useful in combination with fixer electrolysis.

In still another embodiment said fixer starter solution is water or an alkaline solution.

According to the method of the present invention an amount of fixer starter solution is proportional to tank volume of the fixer solution in the processor. In another embodiment according to the method of the present invention an amount of fixer starter solution is less than 10% of volume of replenisher solution with which it is mixed upon starting processing.

Fixer solutions may contain aluminum ions as hardening agent but in a preferred embodiment according to the method of the present invention the fixer is free from aluminum ions. It is clear that the light-sensitive black-and-white silver halide photographic materials processed according to the method of the present invention should be hardened to such an extent that in a fixation step free from aluminum ions no problems as e.g. sludge formation or troubles with physical properties of the materials occur. A survey of hardening agents available in order to foreharden coated hydrophilic gelatinous layers of the said photographic materials has been given e.g. in Research Disclosure 38957, Chapter IIb. As an alternative aluminum salt solutions as e.g. aluminum sulfate may be spray-coated onto or coated in an afterlayer onto the protective antistress layer or another outermost layer of the photographic material, in favour of hardening of the surface layer and in favour of physical properties obtained for the processed material after fixation in a fixer free from hardening aluminum ions, especially with respect to surface glare, pressure sensitivity and unevenness in the processing.

In a process wherein the photographic material passes from the developer to the fixer, said material carries with it a certain amount of developer liquid containing used and unused developing agents and other components. In such process said developing agents thus act as contaminants to the fixer. According to the method of the present invention the fixer is, in a preferred embodiment, contaminated with developer.

While it has been proposed to rinse the photographic material with water or a rinse liquid between developer and fixer, in order to wash off carried-over developer and thus reduce the increase in fixing time which the carried-over developer would cause, the time taken for such rinsing becomes a factor in the overall processing time. As there is a trend towards processes consuming lower amounts of water, a further disadvantage of rinsing with water between the developer and fixer is the production of an additional waste stream.

The efficiency of fixing can be improved by the use of "cascade" fixing, in which the photographic material passes through two or more fixing vessels, the fixer moving counter-current to the photographic material. The period of time spent by the photographic material in the fixer is thereby increased while the volume of fixer required to fill the processing apparatus is increased.

A method and apparatus whereby the retardation of the fixing process caused by carry-over of developer can be minimized with minimum loss of processing speed, even for low replenishing amounts, and without causing additional waste, and where the fixer is further desilvered on-line, has been described in EP-Application 96203298, filed Nov. 25, 1996, which is incorporated herein by reference.

Said method comprises developing the photographic material by treatment with a developer, and fixing the developed photographic material by treatment with a fixer while reducing the level of silver ions in the fixer by electrolysis, characterized in that, between developing and fixing, the photographic material is treated with an intermediate treatment liquid for a period of time less than the treatment time with the fixer, the intermediate treatment liquid containing used fixer.

The apparatus for the processing of photographic material according to the method of the present invention may comprise a plurality of treatment vessels including a developing vessel and a fixing vessel, the apparatus including means for feeding photographic material to be processed along a photographic material path through the developing vessel and the fixing vessel in turn, and an electrolytic cell for removing silver ions from fixer in the fixing vessel, wherein further an intermediate treatment vessel, having a photographic material path length less than that of the fixing vessel, may be positioned between the developing vessel and the fixing vessel and wherein means may be provided for feeding used fixer from the fixing vessel to the intermediate vessel.

It is evident that, according to the method of the present invention, fixer starter solution is added to the first fixer tank in this case, said first tank containing fixer replenisher solution or that the mixture of fixer starter solution and fixer replenisher solution is present in the first tank before starting processing. The apparatus further comprises a pump for pumping used fixer from the second fixing vessel to the first fixing vessel. Alternatively, the fixing vessels may have a cascade relationship whereby used fixer overflows from the fixing vessel into the intermediate vessel as regeneration liquid is added to the fixing vessel.

The treatment vessels may be positioned one above the other in a vertical configuration. In particular, the developing vessel may be positioned above the first fixing vessel which in turn is positioned above the second fixing vessel. This configuration is preferred, in order to prevent fixer from entering the developing vessel. However, in such an arrangement, a pump will be required to transfer used fixer upwardly into the first fixing vessel. Alternatively, the vessels may be positioned side by side in an essentially horizontal configuration, especially where the fixing vessels have a cascade relationship. An electrolytic silver recovery cell may be of known construction. For example, the cell comprises a cylindrical housing fitted with a central anode surrounded by a removable cathode. The housing has inlets and outlets for the liquid to be desilvered. A glass reference electrode enables control of the desilvering process, which is carried out either at constant potential, at constant current or according to some other control regime. As the de-silvering process proceeds, silver is deposited and builds up on the cathode. The cathode is periodically replaced. Silver can be recovered from the used cathode in a known manner, and usually the cathode can be re-used. The silver recovery cell may be an electrolysis unit from an "ECORAP" processor (trade mark product from Agfa-Gevaert NV) or a Curix "EOSFIX" electrolysis unit (trade marketed product from Agfa-Gevaert NV). An apparatus for the electrolytic recovery of silver from solutions containing silver is known from EP-A 0 611 838 and from U.S. Pat. No. 5,639,362.

Use of fixer solution for that intermediate treatment liquid has the effect of triggering the start of the fixing reactions. As a result, once the photographic material passes from the intermediate treatment liquid into the fixer, the fixing reactions quickly reach their optimum rate. It is believed that if photographic material is passed directly from the developer into the fixer, the carried-over developer hampers the fixing process, especially when low fixer regeneration is used. This is particularly the case when electrolytic desilvering is used on-line, since this allows for very low fixer regeneration rates, since the accumulation of silver in the fixer and the corresponding fixing rate decrease is avoided. Preferably the photographic material is treated with the first fixer liquid for a period of time less than half that of the fixer treatment time, most preferably less than 25% that of the fixer treatment time. Where treatment with the fixer takes place in two or more vessels, the intermediate treatment time should be compared with the total fixer treatment time. Treatment with the first fixer liquid for a relatively short period of time can most easily be achieved by providing a shorter photographic material transport path through the intermediate treatment liquid, for example by providing the intermediate treatment liquid in an intermediate vessel having a path length less than that of the vessel containing the fixer, thereby enabling the photographic material to pass through the apparatus at a constant speed. One or more fixing vessels in the method of the present invention are regenerated by addition thereto of the replenisher solution.

According to the method of the present invention the fixer is replenished with fixer replenisher solution in an amount of from 20 up to 100 ml/g of silver to be fixed, more preferably from 20 up to 75 ml/g and still more preferably from 20 up to 50 ml/g of silver calculated on the basis of the replenisher solution having the same composition as that of the fixing solution before addition of fixer starter solution.

Further according to the present invention the fixer is replenished with fixer replenishing solution in an amount proportional to the tank volume of the fixer solution.

Within the scope of the method of the present invention sheet materials such as (medical and industrial) X-ray film, pre-sensitised plates, graphic art films and paper, offset plates etc. can be processed. Particularly any film for medical diagnostic imaging may be processed, wherein said film may be exposed with a laser directed by digitized data obtained after conversion of information captured by suitable means after exposure to radiation of part of the human body or exposed after conversion of X-rays by one or two intensifying light-emitting screen(s) brought into contact with the said film and wherein said film may comprise cubic and/or {111} or {100} tabular silver halide crystals rich in silver chloride and/or crystals rich in silver bromide, crystals rich in silver chloride however being most preferred, provided that with minimum amounts of silver coated a sufficient covering power is attained in the film after rapid ecological processing (with e.g. ascorbic acid and/or derivatives thereof as developing agent(s)) in a (preferentially) hardener-free developer and an odour-free fixer, optionally free from aluminum ions, thereby reducing sludge, with replenishing amounts for developer and fixer as low as possible and further provided that an optimized relationship is attained between sensitometry and image quality, especially sharpness, partly thanks to low cross-over exposure in the case of double-side coated films.

According to the method of the present invention, said method comprises the step of developing in a developing solution, wherein said solution comprises one or more developing agents selected from the group consisting of hydroquinone, 1-phenyl-5-pyrazolidine-1-one, ascorbic acid, reductic acid, stereoisomers or derivatives thereof.

Developing solutions comprising ascorbic acid have e.g. been disclosed in EP-A's 0 731 381, 0 731 382 and 0 732 619.

It is clear that the total processing time wherein the processing cycle is run strongly depends on the amounts of silver coated into the light-sensitive silver halide emulsion layers. According to the present invention the method comprises the steps of developing, rinsing, fixing and drying, wherein the total processing time of these steps is from 30 up to 300 seconds. A time of 300 seconds permits processing of e.g. industrial X-ray films coated with huge amounts of silver as has e.g. been described in EP-A's 0 620 482, 0 620 483, 0 620 484, 0 621 506, 0 622 668 and 0 698 817. More preferred however is a total processing time for the processing cycle comprising the steps of developing, rinsing, fixing and drying of from 30 up to 95 seconds, and for medical X-ray films said time is even more preferred between 30 and 60 seconds as set forth e.g. in EP-A 0 678 772, 0 709 730, 0 712 034 and 0 712 036.

It is clear that the method of the present invention is preferably applied in an automatic processor or processing machine.

While the present invention will hereinafter be described in connection with a preferred embodiment thereof, it will be understood that it is not intended to limit the invention to that embodiment. On the contrary, it is intended to cover all alternatives, modifications and equivalents as may be included in the spirit and scope of the invention as defined by the claims.

6. EXAMPLES

Example 1

This Example is illustrative for the (unexpected) influence of fixer seasoning on photographic results obtained.

As is well-known the sensitometric curve of a photographic system (film/processing combination) is strongly dependent on a large number of parameters among which one is the processing.

Not only usual processing parameters such as processing speed, agitation, developer composition, replenishing rates, immersion times and processing design is determining sensitometric characteristics. In order to show that seasoning of the fixer solution is also a factor influencing sensitometric characteristics two experiments were performed.

The first one was performed with a developer solution continously added as a fresh solution while the fixer solution was seasoning, the second one with a fixer solution added continously as a fresh solution while the developer solution was seasoning. During processing in those differing cycli the sensitometric behaviour of the double side coated medical X-ray film CURIX HTU, trade name product from Agfa-Gevaert N.V., was followed: the said film material was exposed in such a way as to have ⅓ of the said total film surface exposed and ⅔ of the said surface unexposed. The first experiment thus shows the effect of exhaustion of the fixer, while the second experiment shows the effect of exhaustion of the developer. In FIG. 1, data are given about the sensitometric effect on the gradation "GG2" at a density obtained between 1.0 and 2.5 above fog, when the processing proceeds in a processing cycle of 120 seconds at 34° C. in CX330, automatic processing machine, tradename product from Agfa-Gevaert N.V., with developer G138i+starter developer G138Si and fixer G334, tradename products from Agfa-Gevaert N.V., where G138i refers to an improved version of G138. Gradations have been measured for film materials after running 0, 5, 10, 15, 35 and 55 $m^2$ respectively of said materials.

It becomes unexpectedly clear from FIG. 1 that seasoning of the fixer, rather than seasoning of the developer is responsible for the sensitometric changes which occur during seasoning of the processing solutions used in "normal" processing conditions (thus without continuously changing developer or fixer as in these experiments).

Example 2

In this Example the role of the starter solution with respect to its effect of minimizing photographic differences between fresh and seasoned processing solutions has been demonstrated.

Therefore sensitometric decreases in "GG2" in exposure and processing conditions as in Example 1 were performed, in that a "normal" processing cycle was run: upon going from "fresh" to "seasoned" developer and fixer solutions a decrease of GG2 with 12% is observed. In this comparative experiment the "fresh" fixer is the same as the fixer replenisher.

According to the present invention 8% of the developer was added to the fixer G334, tradename product from Agfa-Gevaert NV, wherein said fixer was further replenished during processing with a replenisher having the same composition as G334. As the difference of GG2 before and after seasoning is reduced to less than 3%, the said difference can be considered to be neglectable and the photographic instability to be minimized. On the basis of carry-over and data of replenishment (about 25 ml carry-over, with replenishing amounts of the fixer of 600 ml/$m^2$) one would expect an amount of 4% of the developer in the fixer to be sufficient to obtain identical sensitometric data. In praxis it has been established that an amount of 8% of developer in the fixer is required in order to obtain the desired shift in gradation. Further it can be experimentally measured that pH of the fixer shifts from 4.3 to 4.6.

Therefore in the third experiment pH of the fixer was modified to a value of 4.6, being the same as the end pH in the foregoing experiment, by adding potassium hydroxide. Although an improvement was attained (reduction of GG2 with 5% only) it was established that mere adjustment of the pH didn't give the expected improvement. Apparently other factors than mere pH are involved.

Example 3

This Example is illustrative for the occurrence of smell of the fixer if no fixer starter in the processor is used according to the method of the present invention.

In Table 1, a review of different experiments is given. Parameters in these experiments are the presence (YES) or absence (NO) of a fixer starter solution (FIXSTART); pH of the replenishing solution after addition of the fixer starter solution (where applicable); amounts of replenishment (REPL) expressed in ml/$m^2$; pH of fixer replenisher; pH of the seasoned fixer (pH SEASFIX); the presence (YES) or absence (NO) of smell of the fixer at the start of the processing (SMELL START) and after seasoning (SMELL SEAS).

TABLE 1

| Exp. No. | FIX-START | pH1 | REPL | pH2 | pH SEAS-FIX | SMELL START | SMELL SEAS |
|---|---|---|---|---|---|---|---|
| 1 (comp.) | NO | 4.3 | 600 | 4.3 | 4.5 | YES | NO* |
| 2 (comp.) | NO | 4.6 | 600 | 4.6 | 4.8 | NO | NO* |
| 3 (comp.) | NO | 4.6 | 200 | 4.6 | 5.2 | NO | NO* |
| 4 (comp.) | NO | 4.3 | 200 | 4.3 | 4.8 | YES | NO |
| 5 (inv.) | YES | 4.8 | 200 | 4.3 | 4.8 | NO | NO |

*see remarks in the text hereinafter
pH1 = pH of fixer (replenisher) + starter solution
pH2 = pH of replenisher solution Experiment No. 1 in this Example is an illustration of a classical example of processing of an X-ray film for medical purposes: the fixer has a distinct smell at the start (YES) vs. after seasoning (NO*): smell decreases with time as pH increases due to carry-over of the developer. Nevertheless this may take time in the order of several days, particularly in the case of low film consumption (e.g. only a few $m^2$ per day). The remark should be made that high replenisment amounts are required in this "common" situation.

Experiment No. 2 is illustrative for a decrease in smell (NO–NO*) when a fixer is used having a higher pH value: however as a function of the construction or maintenance of the processor a high carry-over from developer to fixer may cause aluminum ions to become still more insoluble in the fixer solution, thereby forming aluminum-salt deposit. Moreover replenishment amounts stay high.

Experiment No. 3 illustrates that the problem becomes even more severe when low replenishment amounts are used for the fixer: increased cleaning frequency as a result of aluminum-salt deposit are severe drawbacks the processing system is suffering from.

Experiment No. 4, is illustrative for the use of decreased replenishment amounts which require use of a fixer replenisher with a lower pH value in order to avoid aluminum precipitation in the seasoned fixer. However at the start pH of the fixer solution is low, which may cause smell of the processor. In particular at higher processing temperatures as in the processing of medical diagnostic films in 45 seconds at fixer temperatures of 38° C. the problem becomes stringent.

Experiment No. 5, performed according to the method of the present invention illustrates that the use of a fixer starter offers the opportunity to get a constant pH value at the start and during seasoning of the fixer, even at low replenisment rates without the presence of smell, nor of a decreased stability of the fixer due to aluminum deposit.

Example 4

This Example shows that lower replenishment volumes may result in larger variations of the pH value of the fixer, especially when silver is recycled by electrolysis.

The composition of the concentrated fixer solution is given hereinafter:

| | | |
|---|---|---|
| - ammonium thiosulphate | 900 | ml |
| - sodium metabisulphite | 80 | g |
| - sodium acetate | 80 | g |
| - citric acid | 8 | g |

addition of demineralized water in order to make 1 l of fixer solution; pH 5.43.

In order to get a fixer solution ready-for-use a dilution of 1+3 (3 volumes of demineralized water for 1 volume of concentrated fixer) is recommended.

Use of the EOS FIX equipment (trade name product from Agfa-Gevaert N.V.) in combination with a CURIX HT330 processor (trade name product from Agfa-Gevaert) makes pH decrease from a pH at the start of 5.4 to a value of 5.15 (after seasoning, replenishing amounts being 600 ml/$m^2$) and even to a value of 4.8 for lower replenishing amounts (after seasoning, replenishing amounts being 400 ml/$m^2$). For still lower replenishing amounts differences in pH value at the start and after seasoning may even exceed 0.6 pH units. Application of a replenisher having too low a pH value results in too low a pH value after seasoning, whereas application of a replenisher having too high a pH value results in other problems as will be made clear in the Examples 5 and 6.

Example 5

This experiment is illustrative for the drying time (determined three times) of the film in the processor as a function of the pH of the fixer as has been illustrated in FIG. 2. Processor M6/6 (trademark product from Eastman Kodak) was adapted in order to have the film stopped in the drying section of the processor and then measure the time for the film to get dry. In the adapted processor M6/6 a processing cycle of "45 seconds" was run at 37° C.:

| | | |
|---|---|---|
| loading: | 1.8 | sec. |
| developing: | 12.0 | sec. |
| cross-over: | 2.0 | sec. |
| fixing: | 8.0 | sec. |
| cross-over: | 2.0 | sec. |
| rinsing: | 8.0 | sec. |
| drying: | variable | |
| total time: | 33.8 | sec. (before drying) |

The processing composition for the developer was as follows:

| | | |
|---|---|---|
| demineralized water | 300 | ml |
| hydroquinone | 88 | g |
| 4,4'-hydroxymethyl-methyl-phenidone | 4.00 | g |
| potassium iodide | 0.080 | g |
| 5-methylbenzotriazole | 0.300 | g |
| 1-phenyl-5-mercaptotetrazole | 0.030 | g |
| aqueous potassium sulphite (655 g/l) | 365 | ml |
| aqueous potassium carbonate (765 g/l) | 55 | ml |
| aqueous potassium hydroxyde (755 g/l) | 40 | ml |
| Trilon B | 14 | ml |
| Borax | 5.25 | g |
| Diethylene glycol | 86 | ml |

pH (adjusted with potassium hydroxyde) 10.84 Water to make 1 l 1 liter of the concentrated, hardener-free developer, was diluted with 2.39 liter of demineralized water (pH of developer ready-for-use: 10.35). 110 ml of a starter solution was added to make 3.5 l of developer ready-for-use. The starter solution contained 24 g of potassium bromide per 100 ml.

| Composition of the fixer: | | |
|---|---|---|
| ammonium thiosulphate (778 g/l) | 710 | ml |
| sodium metabisulphite | 80 | g |
| sodium acetate.3 aq. | 130 | g |
| acetic acid | 14 | ml |

demineralized water to make 1 liter.

pH of the concentrated fixer was 5.29; after dilution (1+3) the pH value was 5.25. Different pH values of the fixer were made by adding sulfuric acid.

TABLE 2

| | drying time in seconds | | | | |
|---|---|---|---|---|---|
| fixer pH | 4.25 | 4.50 | 4.75 | 5.00 | 5.25 |
| time (s) | 31.7 | 36.1 | 35.5 | 39.0 | 39.7 |
| " | 31.4 | 36.3 | 35.4 | 39.9 | 40.2 |
| " | 31.0 | 35.6 | 36.2 | 40.2 | 38.7 |

For the MAMORAY MR6 film (trade name product from Agfa-Gevaert) it is clear that as pH of the fixer solution increases, there is a distinct increase in the drying time of the film. Variations in drying time may result in partially wet films which may stick together or in "overdried" films which may show unevenness in the processing and uneven gloss, which is particularly forming a problem when processing proceeds in a fixer free from aluminum ions. The said problem has been treated in that context in EP-A 0 806 705.

Example 6

In a CURIX HT330 processor a processing cycle of "60 s" was run:

| | |
|---|---|
| developing | 16.6 sec./35° C. |
| cross-over | 5.0 sec. |
| fixing | 16.6 sec./35° C. |
| cross-over | 5.0 sec. |
| rinsing | 11.0 sec./20° C. |
| drying | 21.0 sec. (cross-over time included) |
| total time | 75.2 sec. |

The processing composition for the developer and the fixer was the same as given hereinbefore in Example 5.

Two fixers differing in pH ready-for-use (by addition of acetic acid) were applied: one having a pH of 4.9 (FIX1), another having a pH value of 4.5 (FIX2).

Two different types of films were run in the two processing cycles differing in fixer pH: one side coated MAMORAY MR7 film and double-side coated CURIX ORTHO DGL film (both trademark products from Agfa-Gevaert N.V.).

The drying unit in the processor was installed in such a way that an unexposed MAMORAY MR7 film was completely dry, in order to test if intermix-processing of different types of films was possible. Therefore the quality of the dried CURIX ORTHO DGL film was examined: a qualitative figure from "0" (perfect) over "1" (good), "2" (acceptable), "3" (bad) to "4" (very bad) was given after examination in reflection of gloss of the processed film and examination of the presence of spots due to drying (especially "overdrying"). At the higher fixer pH of 4.9 the qualitative figure is quickly changing from "1" to "4" if more rapid drying is installed in the processor; at lower pH (4.50) a figure of "1" is attainable for the films in the same drying conditions.

We claim:

1. Method of processing in a processor an image-wise exposed black-and-white light-sensitive silver halide photographic material comprising the steps of developing in a developing solution and fixing in a fixer solution, characterized in that upon starting of the processing the said fixer solution comprises a mixture of a fixer starter solution and a fixer replenisher solution, in that said fixer solution is replenished with the said fixer replenishing solution and in that the said fixer starter solution is a developing solution.

2. Method according to claim 1, comprising the step of mixing said fixer starter solution and a fixer replenisher solution in a fixer unit or tank of the said processor.

3. Method according to claim 2, wherein said fixer starter solution is mixed with the fixer replenishing solution in the processor before starting processing.

4. Method according to claim 1, wherein the fixer starter solution comprises developing agent(s) in a molar amount versus thiosulphate ions in the fixer replenisher solution of from 0.015 up to 0.080.

5. Method according to claim 1, wherein said fixer starter solution alters pH to a value in the range from −0.3 up to +0.3 units of the pH of the fixer solution after seasoning.

6. Method according to claim 1, wherein said fixer solution is free from aluminum ions.

7. Method according to claim 1, wherein an amount of fixer starter solution is proportional to tank volume of the fixer solution in the processor.

8. Method according to claim 1, wherein an amount of fixer starter solution is less than 10% of volume of replenisher solution with which it is mixed upon starting processing.

9. Method according to claim 1, wherein said fixer is replenished with fixer replenisher solution in an amount of from 20 up to 100 ml/g of silver to be fixed.

10. Method according to claim 1, further comprising the step of developing in a developing solution comprising one or more developing agents selected from the group consisting of hydroquinone, 1-phenyl-5-pyrazolidine-1-one, ascorbic acid, reductic acid, stereoisomers or derivatives thereof.

11. Method according to claim 1, comprising the steps of developing, rinsing, fixing and drying, wherein the total processing time of these steps is from 30 up to 300 seconds.

12. Method according to claim 1, comprising the steps of developing, rinsing, fixing and drying, wherein the total processing time of these steps is from 30 up to 90 seconds.

* * * * *